United States Patent [19]

Miles

[11] 4,356,087

[45] Oct. 26, 1982

[54] RODENT BARRIER DEVICE

[76] Inventor: Robert A. Miles, Barrett, Minn.

[21] Appl. No.: 295,840

[22] Filed: Aug. 24, 1981

[51] Int. Cl.[3] ..... B01D 33/00

[52] U.S. Cl. ..... 210/131; 210/163; 210/359; 43/66

[58] Field of Search ..... 405/36, 99, 100; 256/23; 43/66; 210/131, 163, 170, 359; 49/49

[56] References Cited

U.S. PATENT DOCUMENTS

| | | | |
|---|---|---|---|
| 233,853 | 11/1880 | Heafer | 43/66 X |
| 818,288 | 4/1906 | Race | 210/359 X |
| 906,562 | 12/1908 | Rue | 210/131 |
| 1,505,996 | 8/1924 | Drought | 43/66 |
| 2,691,231 | 10/1954 | Cook | 49/49 |
| 4,110,216 | 8/1978 | Wagnon et al. | 210/170 X |

*Primary Examiner*—James A. Leppink
*Assistant Examiner*—Nancy J. Pistel
*Attorney, Agent, or Firm*—Williamson, Bains, Moore & Hansen

[57] ABSTRACT

A barrier device for installation in a drain tile adjacent the outlet of the tile includes a plurality of spaced apart barrier elements affixed to a sleeve to define a perforate gate. The gate is swingably mounted on a pivot rod which projects transversely through openings in the tile adjacent the outlet of the latter. The barrier elements, which are in the form of rods, are affixed to the sleeve to normally urge the gate to a closed position by action of gravity to thereby prevent entry by small animals into the tile. The gate may swing to the open position when engaged by floating debris to thereby permit passage of the debris through the drain tile outlet.

4 Claims, 3 Drawing Figures

RODENT BARRIER DEVICE

SUMMARY OF THE INVENTION

This invention relates to a barrier device for installation in a drain tile to prevent entry of small animals into the drain tile.

Drain tile is commonly used to drain excess ground water from tillable fields to accelerate the time when fields can be worked. However, small animals often attempt to build a nest or hibernate in drain tile which sometimes results in the tile becoming clogged. Various types of barriers have been developed for installation in the drain tile to prevent the entry of small animals into the tile, but many of these barriers have certain undesirable features.

It is therefore a general object of this invention to provide an improved barrier device which permits water and water-entrained debris to be moved past the barrier device but which prevents small animals from entering the drain tile.

A more specific object of this invention is to provide an improved barrier device including a water pervious gate pivotally mounted in the drain tile which will pivotally swing to an open position when engaged by water and tank trained debris but which normally swings to an obstructing position by action of gravity to thereby prevent small animals from entering the drain tile.

These and other objects and advantages of this invention will more fully appear from the following description made in connection with the accompanying drawings, wherein like reference characters refer to the same or similar parts throughout the several views.

FIGURES OF THE DRAWINGS

DESCRIPTION OF THE PREFERRED EMBODIMENT OF THE INVENTION

Figure 3:
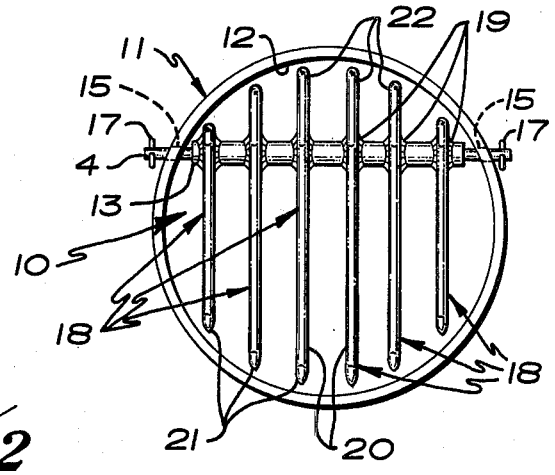
FIG. 3 is an elevational view taken approximately along line 3—3 of FIG. 2 and looking in the direction of the arrows.
Figure 1:
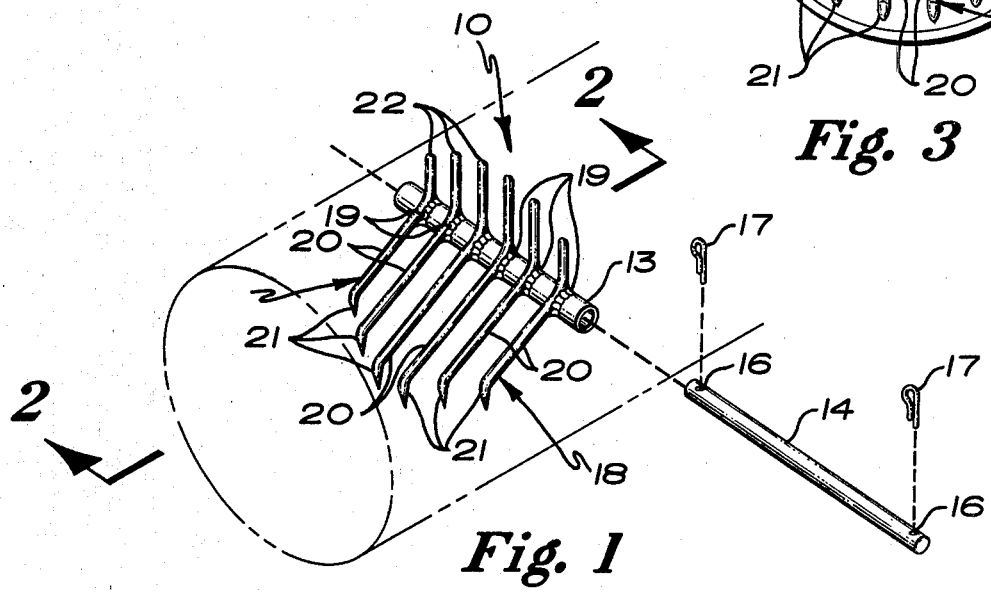
FIG. 1 is an exploded perspective view of the novel barrier illustrating its position in a drain tile.

Referring now to the drawings, it will be seen that one embodiment of the novel barrier device designated generally by the reference numeral 10, is thereshown. The barrier device 10 is in the form of a swingable gate which is mounted interiorly and transversely of a drain tile 11 which is of cylindrical configuration and which has a cylindrical interior 12. Drain tile 11 is of the type which is located below the surface of the ground and which serves to drain excess ground water from agricultural fields to permit the fields to be worked. Oftentimes, the fields become waterlogged just after a rain fall or after the spring thaw and the drain tile facilitate removal of the excess ground and surface water. The barrier device 10 is positioned adjacent the outlet end of the drain tile and serves to prevent small animals from using the drain tile as a ready-made burrow. When small animals build nests or hibernate within the drain tile, very often the drain tile becomes clogged with the material used by the animal. It is therefore essential that the barrier device permits the passage of water and water entrained debris through the outlet of the drain tile but prevent entry of small animals into the drain tile.

Figure 2:
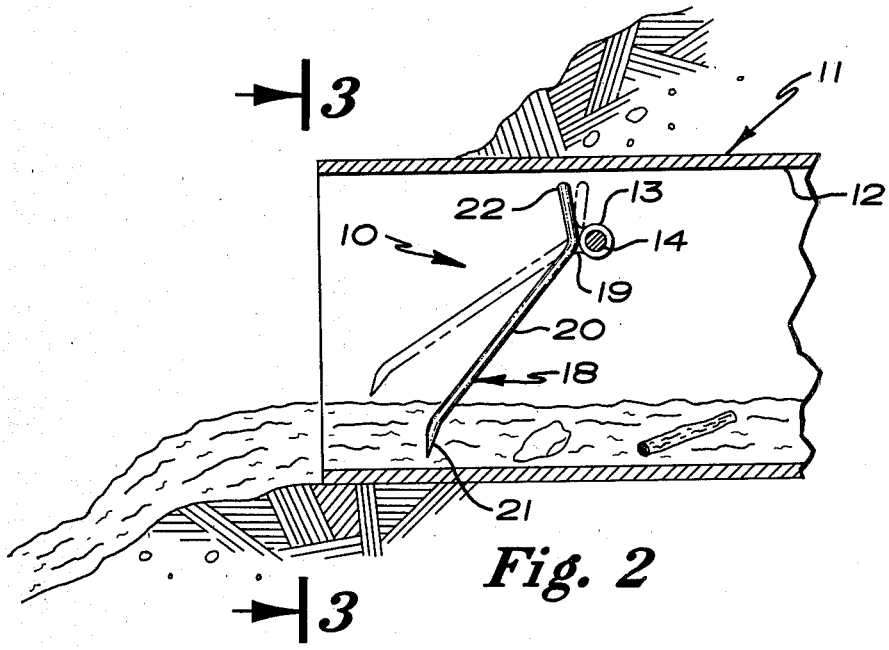
FIG. 2 is a cross-sectional view taken approximately along line 2—2 of FIG. 1 and looking in the direction of the arrows.

It will be seen that the barrier device 10 includes an elongate, cylindrical sleeve 13 which is positioned around an elongate pivot rod 14. The pivot rod 14 extends transversely of the drain tile, as best seen in FIG. 2, and opposite ends thereof project through registering openings 15 in the drain tile. It will also be noted that the ends of the pivot rod 14 project exteriorly of the drain tile and each is provided with a transverse opening 16 therethrough. Suitable cotter pins 17 are positioned in the opening 16 and retain the pivot rod in transversely extending relation interiorly of the drain tile. It will also be noted that while the pivot rod 14 extends transversely of the drain tile, it is not centrally located but is located closer to the upper arcuate portion of the drain tile, as best seen in FIG. 3. In this regard, the drain tile is normally horizontally oriented but is inclined slightly downwardly towards its outlet.

The cylindrical sleeve 13 extends around pivot rod 14 throughout the major length of the pivot pin and is rotatable relative thereto. The gate device also includes a plurality of elongate, rigid barrier elements 18, which as seen, are in the forms of rods. It will also be seen that the barrier elements 18 are rigidly affixed to the sleeve 13 by suitable welds 19 intermediate the ends of the respective barrier elements. Although the barrier elements are spaced apart in substantially parallel relation, as best seen in FIG. 3, it will be noted that the barrier elements are of different lengths. Each barrier element includes an elongate substantially straight lower portion 20 which terminates in pointed ends 21 which are angularly bent from the general longitudinal axis of the associated lower portion. Each barrier element also includes an upper portion 22 which is angularly bent with respect to the lower portion 20. In this regard, it will be noted that the lower portion extends downwardly and forwardly from the sleeve 15 while the upper portion extends upwardly and slightly forwardly from the sleeve. Referring again to FIG. 3, it will be noted that the spacing between adjacent barrier elements is substantially equal and that the respective lower portions all lie in the same general plane. Similarly, the respective upper portions of the barrier elements also are disposed in substantially the same plane.

Referring again to FIG. 2, it will be seen that the length of the lower portion 20 of each barrier elements is substantially greater than the length of the associated upper portion 22 thereof. It will also be seen that the length of each barrier element is substantially greater than that portion of the interior of the drain tile which it transects. Finally, it will be seen that each barrier element is welded to that surface of the sleeve which is located closest to the outlet of the drain tile. For the purposes of this application, that surface will be designated the front surface. With this arrangement, the lower portion of each barrier element tends to swing downwardly and to the rear, as viewed in FIG. 2, so that the lower pointed end 21 of each barrier element engages the lower interior surface of the drain tile. This downward swinging, of course, is a result of the reaction of the barrier device to gravity. When small animals attempt to enter the drain tile, these small animals usually attempt to push the barrier device to negotiate their way past the barrier device. However, this type of action by the animals only urges the barrier device in a closing obstructing direction. Since the lower ends of barrier elements engage the tile, further movement of the barrier elements in this closing direction is prevented. In the event that the animal attempts to raise the lower portion of the barrier elements, the pointed ends 21 will tend to pierce the animal and thereby discourage this type of entry.

Ground water flowing through the drain tile may readily pass between the barrier elements and in the event that there is any water entrained material in the ground water, the material will strike the lower portion of the barrier elements and permit swinging movement of the barrier device to the open position thereby permitting the material to flow through the outlet of the drain tile.

From the foregoing description, it will be seen that I have provided a novel barrier device, which is not only of simple and inexpensive construction, but one which functions in a more efficient manner than any heretofore known comparable device.

It is anticipated that various changes can be made in the size, shape and construction of the barrier device disclosed herein without departing from the spirit and scope of the invention as defined by the following claims.

What is claimed is:

1. A barrier device for use in preventing animals, such as rodents, from entering drain tile of the type used to drain water from fields, said device comprising:

a pivot rod adapted to be positioned in a generally horizontally disposed drain tile transversely thereof so that the opposite ends of the pivot rod project through opposed registering openings in drain tile, said pivot rod having means at opposite ends thereof for retaining the pivot rod in mounted relation interiorly of the drain tile;

an elongate sleeve mounted on said pivot rod for limited pivotal movement relative thereto, a plurality of transversely spaced apart elongate barrier elements affixed to said sleeve intermediate the respective ends of said elements for pivotal movement with the sleeve between opened and closed positions, each of said barrier elements including an upper portion extended upwardly from said sleeve and a lower portion extending forwardly and downwardly from said sleeve, the lower end of said lower portion of each barrier element being angularly bent and pointed, the lower portion of each barrier element having a length dimension substantially greater than the length dimension of the corresponding upper portion whereby the barrier elements normally swing downwardly and rearwardly by action of gravity to the closed position and engage the lower inner surface of the tile but may swing forwardly and upwardly in response to debris carried by water to permit said debris to pass beyond the barrier device and outwardly of the drain tile.

2. The barrier device as defined in claim 1 wherein certain of said barrier elements are of different lengths.

3. The barrier device as defined in claim 1 wherein said barrier elements are disposed in parallel relation with respect to each other.

4. The barrier device as defined in claim 1 wherein the respective lower portions of certain of said barrier elements are of different lengths and the respective upper portions of certain of said barrier elements are of different lengths.

* * * * *